US006696908B2

(12) United States Patent
Okano et al.

(10) Patent No.: US 6,696,908 B2
(45) Date of Patent: Feb. 24, 2004

(54) COIL BOBBIN

(75) Inventors: Kohei Okano, Sakado (JP); Yuji Haga, Ogawamachi (JP); Atsushi Aikawa, Tsurugashima (JP)

(73) Assignee: Tamura Corporation, Tokyo (JP)

( * ) Notice: Subject to any disclaimer, the term of this patent is extended or adjusted under 35 U.S.C. 154(b) by 0 days.

(21) Appl. No.: 10/198,282

(22) Filed: Jul. 18, 2002

(65) Prior Publication Data

US 2003/0030531 A1 Feb. 13, 2003

(30) Foreign Application Priority Data

Aug. 8, 2001 (JP) ..... 2001-240316

(51) Int. Cl.[7] ..... H01F 27/30
(52) U.S. Cl. ..... 336/198; 336/107; 336/192
(58) Field of Search ..... 336/65, 107, 192, 336/198, 200, 206–208, 232

(56) References Cited

U.S. PATENT DOCUMENTS 5,200,731 A * 4/1993 Tochio et al. ..... 336/192

FOREIGN PATENT DOCUMENTS

| | | | |
|---|---|---|---|
| DE | 3446040 A1 | * | 6/1986 |
| JP | S58-25012 | | 2/1983 |
| JP | S60-172327 | | 11/1985 |
| JP | S61-81111 | | 5/1986 |
| JP | 61-172318 | * | 8/1986 |

* cited by examiner

*Primary Examiner*—Tuyen T. Nguyen
(74) *Attorney, Agent, or Firm*—Dennis G. LaPointe; Mason Law, P.A.

(57) ABSTRACT

To provide a coil bobbin for a transformer in which no through hole is formed in both sides of an upper flange to thereby prevent upsizing, and no long arm apt to splinter is formed on a terminal board, and the terminal board can be readily mounted to a flange. In the coil bobbin in which an end of an upper flange (3) formed on an upper end of a drum (2) is formed with a terminal board mounting portion (5), and in which a separately formed terminal board (8) is mountable on the terminal board mounting portion (5), an inside of the terminal board mounting portion (5) is formed with a rib (7), whose upper portion is formed with a plurality of plate-like walls, and an inner end of the terminal board (8) is formed with a plurality of through holes (17) in which said walls are inserted.

16 Claims, 10 Drawing Sheets

10A

10B

COIL BOBBIN

BACKGROUND OF THE INVENTION

1. Field of the Invention

The present invention relates to a coil bobbin for a transformer used, for example, in a large AV amplifier which is recently more used with the spread of DVD, more particularly, to a coil bobbin provided with a separate terminal board.

2. Description of the Related Art

A coil bobbin of this type is known as disclosed in Japanese Utility Model Application No. 56-118376 wherein a coil bobbin and a terminal board are separately formed, and the terminal board is mounted on a flange of the coil bobbin during assembly.

FIG. 13 is a perspective view of a flange portion of a coil bobbin 30 and a terminal board 31 to be mounted on the flange portion of the above described conventional example.

In this conventional example, through holes 33 for mounting the terminal board are formed at both ends of a terminal board mounting portion which is formed at an end of an upper flange 32 of the coil bobbin 30. Long arms 35 for mounting are formed at both ends of a lower surface of the terminal board 31 in which terminals 34 are implanted, and hooks 36 are formed on outsides of tips of the arms 35.

When the terminal board 31 is mounted on the terminal board mounting portion of the upper flange 32 of the coil bobbin 30, the arms 35 formed with the hooks 36 at their tips are inserted in the through holes 33 in the upper flange 32 so that the hooks 36 reach a lower side of the upper flange 32. The hooks 36 prevent the terminal board 31 from coming off and fix the terminal board 31 to the terminal board mounting portion of the upper flange 32.

The coil bobbin 30 of the conventional example has a problem that spaces where the through holes 33 for mounting the terminal board 31 are formed must be secured at both sides of the upper flange 32, thus leading to an increase in an outer dimension.

Further, there is a problem that the long arms 35 formed from molding on the terminal board 31 are apt to splinter.

BRIEF SUMMARY OF THE INVENTION

The present invention is achieved in view of the above and has its object to provide a coil bobbin for a transformer wherein no through hole is formed in both sides of an upper flange to thereby prevent upsizing, no long arm apt to splinter is formed on a terminal board, the terminal board can be readily mounted to the flange, and even when the terminal board formed from the molding warps, the warp can be corrected by the mounting.

The present invention attains the above described object according to a configuration of a coil bobbin in which an end of an upper flange 3, 3A, 3B formed on an upper end of a drum 2, 2A, 2B is formed with a terminal board mounting portion 5, 5A, 5B, and in which a separately formed terminal board 8, 8A, 8B is mountable on the terminal board mounting portion 5, 5A, 5B, wherein an inside of the terminal board mounting portion 5, 5A, 5B is formed with a rib 7, whose upper portion is formed with a plurality of plate-like walls, and an inner end of the terminal board 8, 8A, 8B is formed with a plurality of through holes 17 in which the walls are inserted.

Another feature of the present invention is that an inner surface of the terminal board 8, 8A, 8B is formed with a projection 14 for engagement, and that the above described wall is formed with a through hole 9*a* or recess 9*b* to be engaged with the projection 14.

Still another feature of the present invention is that an inner end of the terminal board 8, 8A, 8B is formed with outer clipping tabs 16 placed on an outside of the rib 7 and a concavity 13 placed on an inside of the rib 7, such that the rib 7 is clipped between the outer clipping tabs 16 and the concavity 13.

Yet another feature of the present invention is that the inner end of the terminal board 8, 8A, 8B is formed with the outer clipping tabs 16 placed on the outside of the rib 7, the concavity 13 placed on the inside of the rib 7, and also formed with inner clipping tabs 15, and that the rib 7 is clipped therebetween.

Further feature of the present invention is that at least two reinforcing ribs 18, 18A are formed on an upper surface of the terminal board mounting portion 5.

DETAILED DESCRIPTION OF THE PREFERRED EMBODIMENTS

Figure 1:
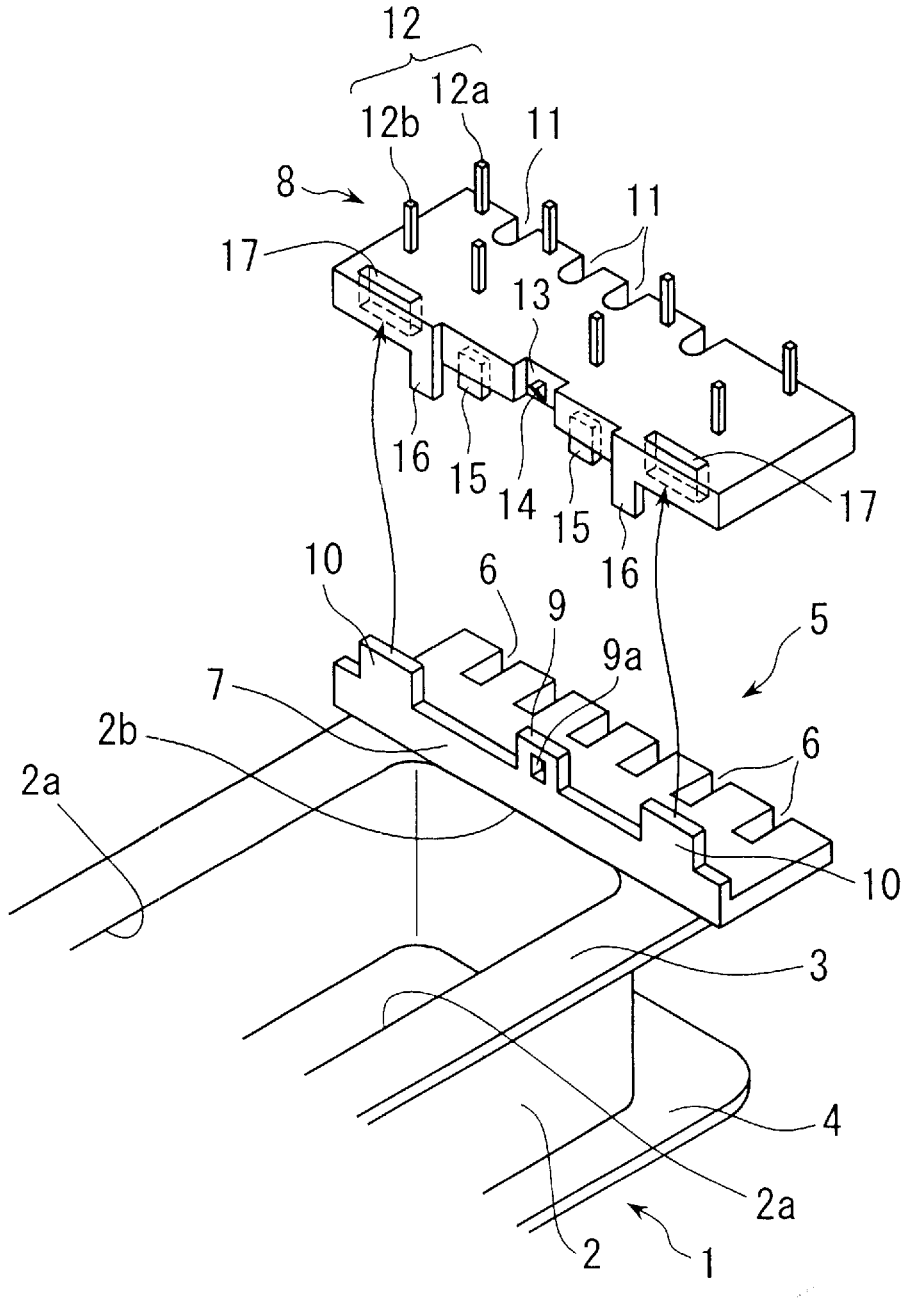
FIG. 1 is an exploded perspective view of essential portions of a first embodiment of the present invention.

In the present invention, a rib 7 for positioning a core, which is formed on upper flange 3, 3A, 3B of a coil bobbin 1 is used, and part of the rib 7 is extended upwardly to be formed with an oblong plate-like central wall 9 for mounting a terminal board and respective side walls 10 on both sides thereof, and dead spaces at an inner end of a terminal board 8 are used to be formed with oblong rectangular through holes 17 in which the side walls 10 are inserted, thus not upsizing the coil bobbin 1 or terminal board 8.

Further, even when the terminal board 8, 8A, 8B formed from oblong molding warps outwardly resulting from being formed with deep drawing grooves, the terminal board 8 may be mounted on the terminal board mounting portion 5 with the warp corrected by the side walls 10 respectively inserted in the through holes 17 formed in both sides of the inner end of the terminal board 8.

[Embodiment 1]

Figure 2:
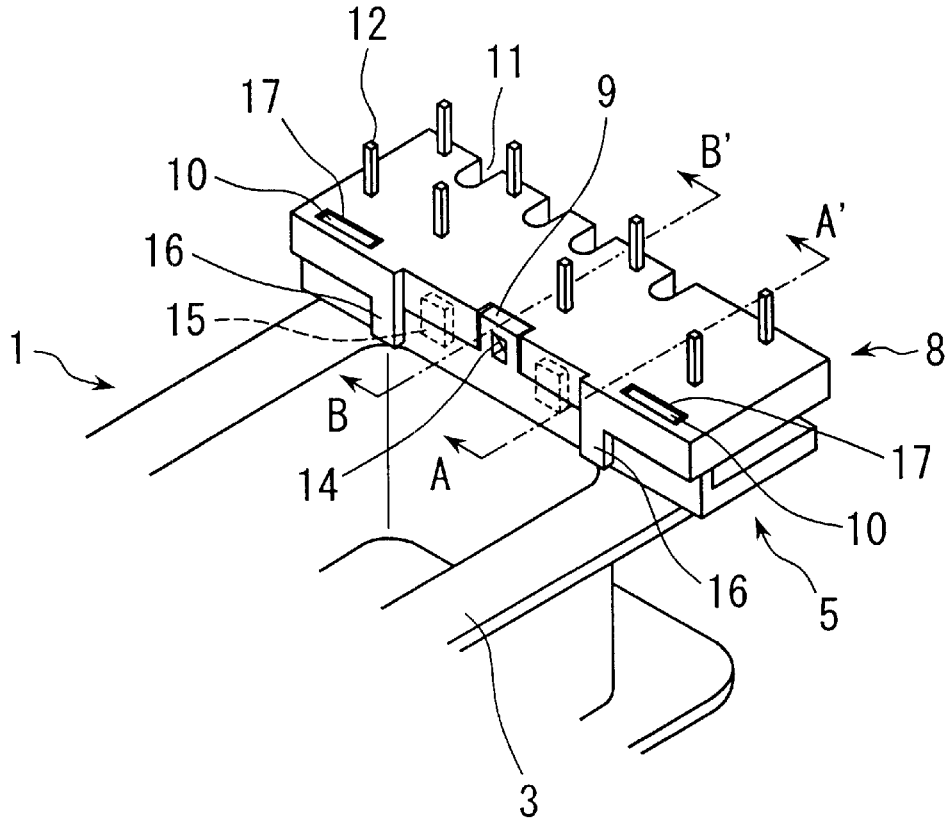
FIG. 2 is an assembled perspective view of the essential portions of the first embodiment of the present invention.
Figure 3:
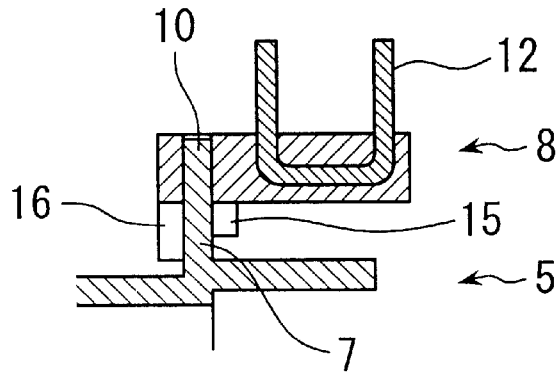
FIG. 3 is a cross-sectional view along a line A–A' in FIG. 2.
Figure 4:
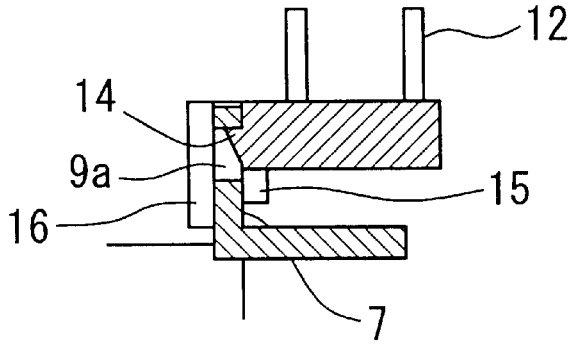
FIG. 4 is a cross-sectional view along a line B–B' in FIG. 2 and shows a state where a projection for preventing coming off formed on a terminal board side engages in a through hole formed in a flange of a coil bobbin.
Figure 5:
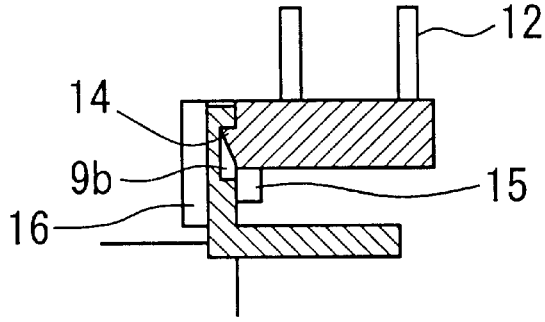
FIG. 5 shows a state where the projection for preventing coming off of the terminal board engages in a recess formed in the flange of the coil bobbin instead of the above described through hole.

Embodiments of the present invention will be described below with reference to the drawings. FIG. 1 is an exploded perspective view of essential portions of a first embodiment of the present invention. FIG. 2 shows an assembled state thereof. FIG. 3 is a cross-sectional view along a line A–A' in FIG. 2, FIG. 4 is a cross-sectional view along a line B–B' in FIG. 2, and FIG. 5 shows another example of the section along the line B–B' in FIG. 2.

In FIGS. 1 to 4, the coil bobbin 1 has a hollow drum 2 around which a coil (not shown) is wound and in which a central leg of a core (not shown) is inserted. The drum 2 is formed into an angle tubular constituted by a pair of long sides 2*a* and a pair of short sides 2*b* (see FIG. 1).

A top of the drum 2 is formed with the upper flange 3, and a bottom thereof is formed with a lower flange 4.

An end of the upper flange 3 is formed with the terminal board mounting portion 5 extending outwardly. The terminal board mounting portion 5 is provided on one of the short sides 2*b* of the drum 2 in an outwardly extending manner.

An outer end of the terminal board mounting portion 5 is formed with drawing grooves 6 for drawing a plurality of lead wires at appropriate intervals. An inner end of the terminal board mounting portion 5 is provided with the rib 7 for mounting a terminal board in a standing manner. The rib 7 also functions as a member for positioning a core (not shown).

An upper portion of the rib 7 is shaped to have projections and recesses, and a central portion thereof is formed with the rectangular plate-like central wall 9 having a through hole 9*a* for preventing coming off of the terminal board 8 when mounted. Both sides thereof are respectively formed with the rectangular plate-like side walls 10.

A plane of the terminal board 8 is shaped into an oblong rectangle, and its long side is formed to have a length substantially identical to a length of the rib 7 of the terminal board mounting portion 5.

An outer end of the terminal board 8 is formed with a plurality of drawing grooves 11 for guiding the lead wires at appropriate intervals. The number of the drawing grooves 11 is not necessarily the same as the number of the drawing grooves 6 of the terminal board mounting portion 5, but when the terminal board 8 is mounted to the terminal board mounting portion 5, any one of the drawing grooves 6 is placed on substantially the same position as any one of the drawing grooves 11 to be aligned therewith.

An upper surface of the terminal board 8 is provided with a plurality of terminals 12 at appropriate intervals. The terminals 12 are substantially in U shapes, and their lower portions are embedded in the terminal board 8, and outer terminals 12*a* and inner terminals 12*b* extend upwardly from the upper surface of the terminal board 8. The terminals 12 are not necessarily in U shapes.

A center of an inner surface of the terminal board 8 is formed with a concavity 13, whose central portion is formed with a projection 14 for engagement which prevents upward coming off of the terminal board 8 when mounted to the terminal board mounting portion 5 from above, and the projection 14 is inserted in the through hole 9*a* for engagement of the central wall 9.

Positioned on both sides of the concavity 13 on an inside of a lower surface of the terminal board 8 are inner clipping tabs 15, which are on an outside of the rib 7. Outsides of the inner clipping tabs 15 are formed with outer clipping tabs 16 placed on an inside of the rib 7 to be abutted thereon, and the inner and outer clipping tabs 15, 16 are configured to clip the rib 7.

The rib 7 is also clipped between the outer clipping tabs 16 placed on its outside and a concavity 13 placed on its inside. Thus, the inner clipping tabs 15 are not necessarily required and may be eliminated. However, when the inner clipping tabs 15 are provided, the rib 7 can be clipped more reliably by the outer clipping tabs 16, concavity 13 and inner clipping tabs 15.

Both sides of the inner end of the terminal board 8 are respectively formed with through holes 17 in which the side walls 10 formed on the rib 7 are inserted.

Figure 13:
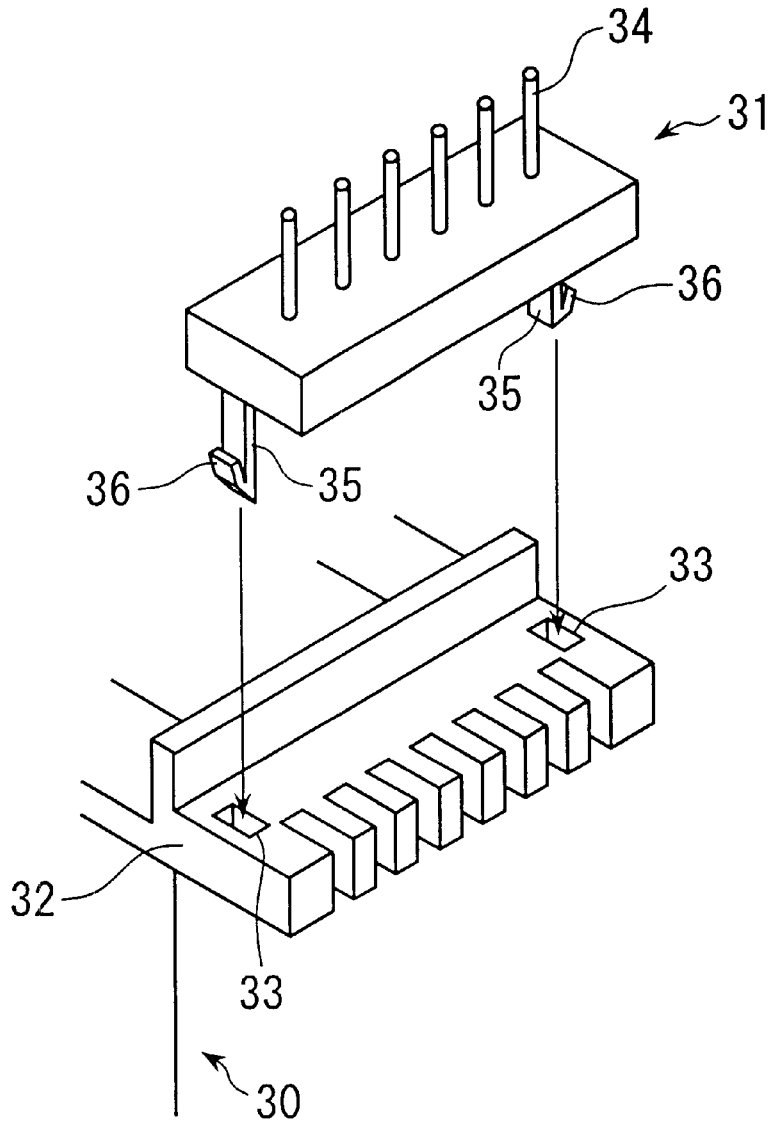
FIG. 13 PRIOR ART
FIG. 13 shows a conventional example.

In a conventional example shown in FIG. 13, both sides of a terminal board mounting portion of an upper flange 32 of a coil bobbin 30 are provided with through holes 33, in which hooks 36 on arms 35 of a terminal board 31 engages. Therefore, there is a disadvantage that spaces for providing the through holes 33 must be secured on both sides of the terminal board mounting portion, which leads to increases in a length of the terminal board mounting portion, dimension of the coil bobbin 30, and also dimension of the terminal board 31.

In the present invention, the rib 7 for positioning the core, which is formed on the upper flange 3 of the coil bobbin 1 is used, and part of the rib 7 is extended upwardly to be formed with the oblong plate-like central wall 9 for mounting the terminal board and side walls 10, and the dead spaces at the inner end of the terminal board 8 are used to be formed with the oblong rectangular through holes 17 in which the side walls 10 are inserted, thus not upsizing the coil bobbin 1 and terminal board 8.

Next, a method of mounting the terminal board 8 on the terminal board mounting portion 5 of the upper flange 3 of the coil bobbin 1 will be described.

As shown in FIG. 1, the terminal board 8 is placed above the terminal board mounting portion 5 and lowered toward the terminal board mounting portion 5, and as shown in FIGS. 2 and 3, the respective side walls 10 are inserted in the respective through holes 17 to be mounted thereto. Further, the rib 7 is clipped between the outer clipping tabs 16 and concavity 13 to ensure preventing rattling of the terminal board 8 and permit firm mounting of the terminal board 8 to the terminal board mounting portion 5. Forming the inner clipping tabs 15 on the lower surface of the terminal board 8 permits firmer mounting of the terminal board 8 to the terminal board mounting portion 5.

When a projection 14 on the concavity 13 of the terminal board 8 is inserted to be engaged in the through hole 9*a* of the central wall 9 of the terminal board mounting portion 5 as shown in FIGS. 1, 2 and 4, the upward coming off of the terminal board 8 can be prevented. In this case, the projection 14 for preventing the coming off has no high rib so as not to prevent mounting of the terminal board 8 to the terminal board mounting portion 5, so that mounting and insertion in the through hole 9*a* can be smoothly carried out.

Instead of the through hole 9*a*, a recess 9*b* may be provided as shown in FIG. 5, and the projection 14 may be inserted to be engaged in the recess 9*b* to prevent the upward coming off of the terminal board 8.

[Embodiment 2]

Figure 6:
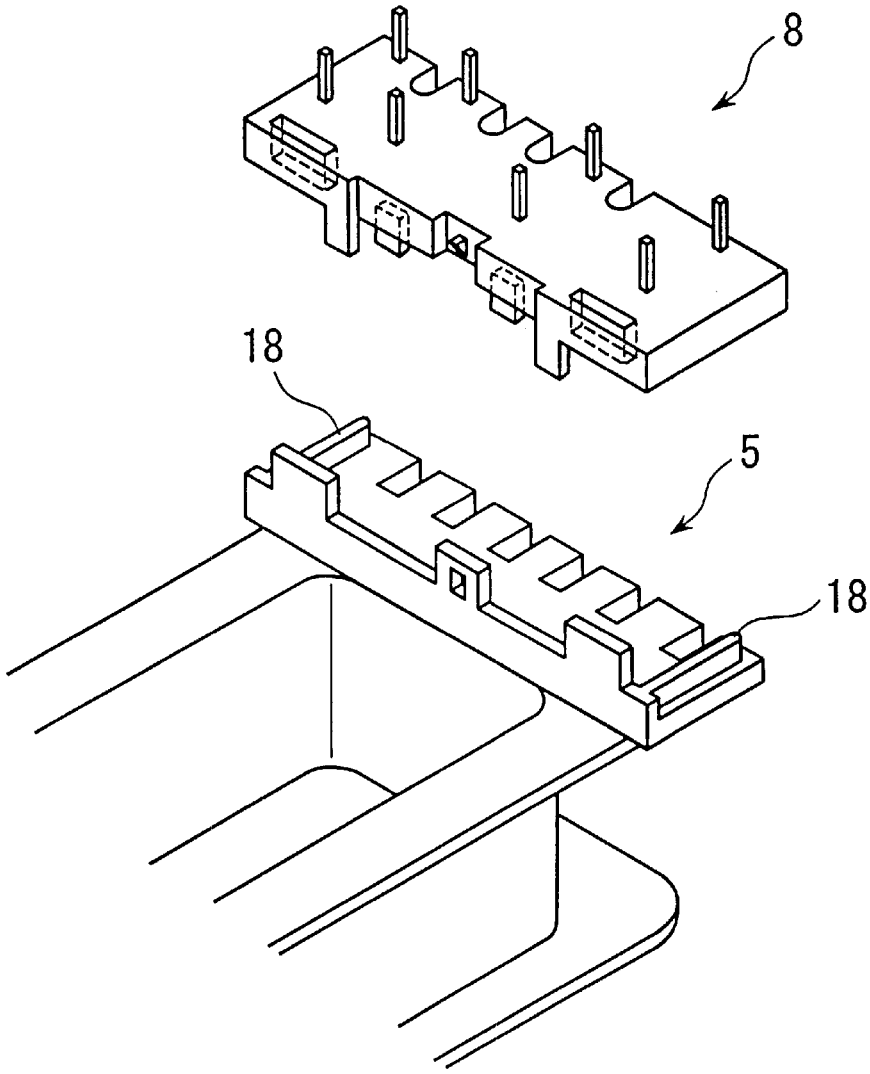
FIG. 6 is an exploded perspective view of essential portions of a second embodiment of the present invention.
Figure 7:
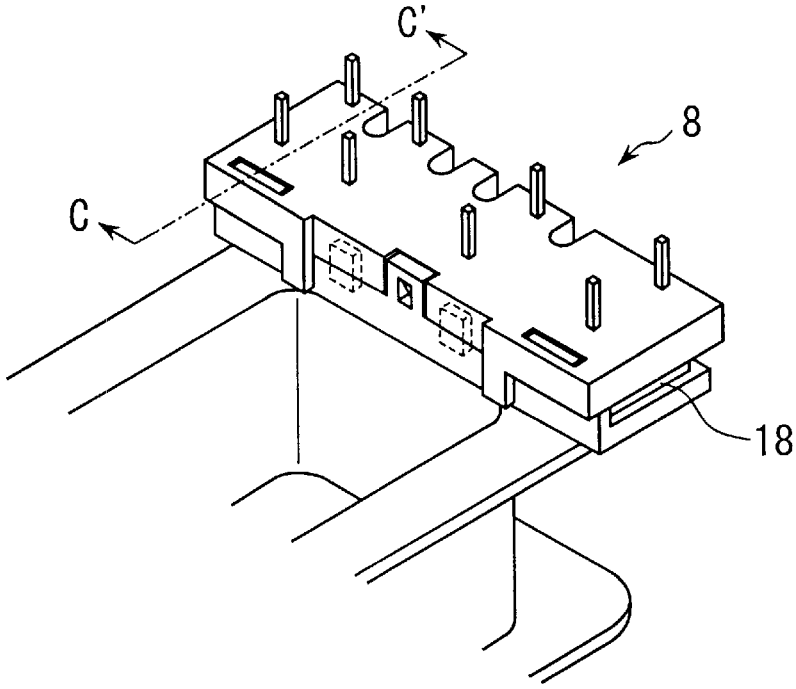
FIG. 7 is an assembled perspective view of the essential portions of the second embodiment of the present invention.
Figure 8:
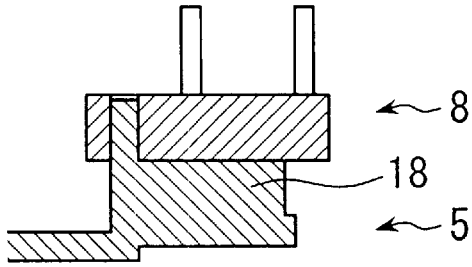
FIG. 8 is a cross-sectional view along a line C–C' in FIG. 7.

FIG. 6 is an exploded perspective view of essential portions of a second embodiment of the present invention, FIG. 7 is an assembled perspective view thereof, and FIG. 8 is a cross-sectional view along a line C–C' in FIG. 7.

This embodiment has a feature in respectively forming reinforcing ribs 18 on both sides of an upper surface of a terminal board mounting portion 5 as shown in FIG. 6.

Therefore, when the terminal board 8 is mounted to the terminal board mounting portion 5, the terminal board 8 is supported by the reinforcing ribs 18 as shown in FIGS. 7 and 8. Forming the reinforcing ribs 18 on both sides is for the purpose of permitting stable support in balance.

Other configurations are the same as in the above described first embodiment.

[Embodiment 3]

Figure 9:
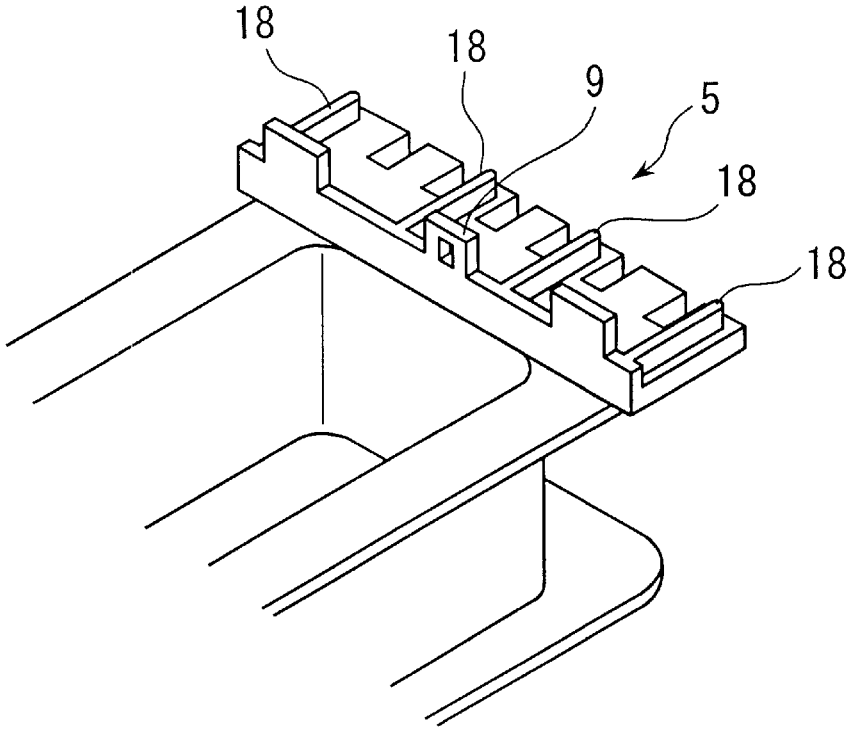
FIG. 9 is a perspective view of essential portions of a third embodiment of the present invention.

FIG. 9 shows a third embodiment of the present invention. This embodiment has a feature in respectively forming reinforcing ribs 18 also between a central wall 9 and respective side walls 10 of a terminal board mounting portion 5. Other configurations are the same as in the above described embodiments.

The number of the reinforcing ribs 18 may be at least two, and may be appropriately increased or decreased depending on the size of the terminal board. As for the position, the reinforcing ribs 18 may be appropriately placed in preferable positions.

[Embodiment 4]

Figure 10:
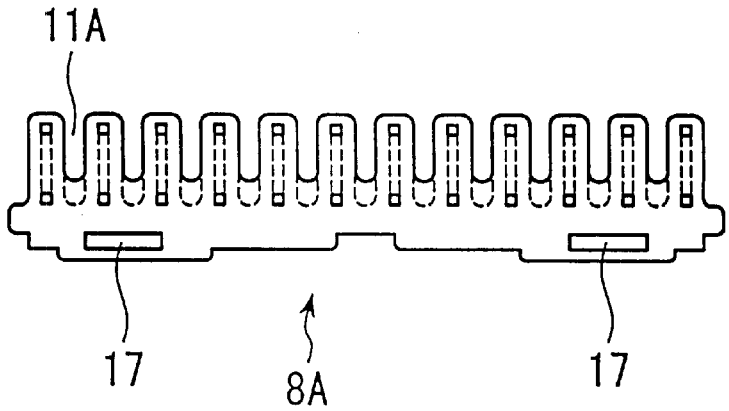
FIG. 10A is a plan view of a terminal board of a fourth embodiment of the present invention.
FIG. 10B is a plan view of a state where the terminal board warps.
Figure 10:
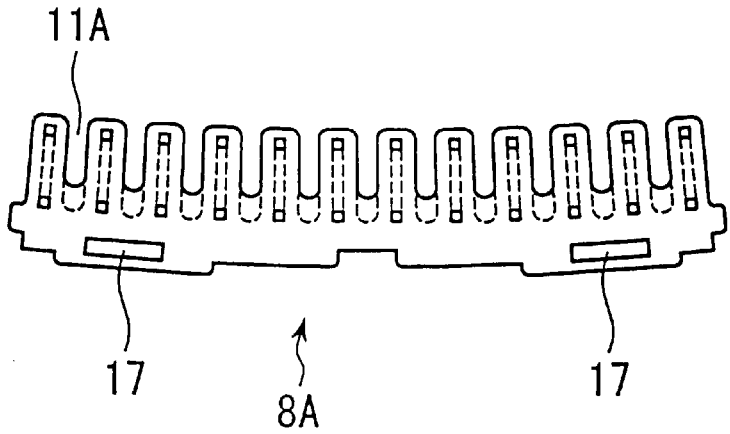

FIG. 10A shows a fourth embodiment of the present invention. This embodiment shows an example of increasing a length of a terminal board 8 and forming numbers of drawing grooves 11A deeply cut from outside to inside. Other configurations are the same as in the above described embodiments.

There is a possibility that the terminal board 8 thus formed from molding with numbers of deep drawing grooves 11A warps and deforms as shown in FIG. 10B.

However, the terminal board 8 of the present invention is configured to insert side walls 10 shown in FIG. 1 for example in through holes 17, which permits readily correcting the warp of the terminal board 8.

[Embodiment 5]

Figure 11:
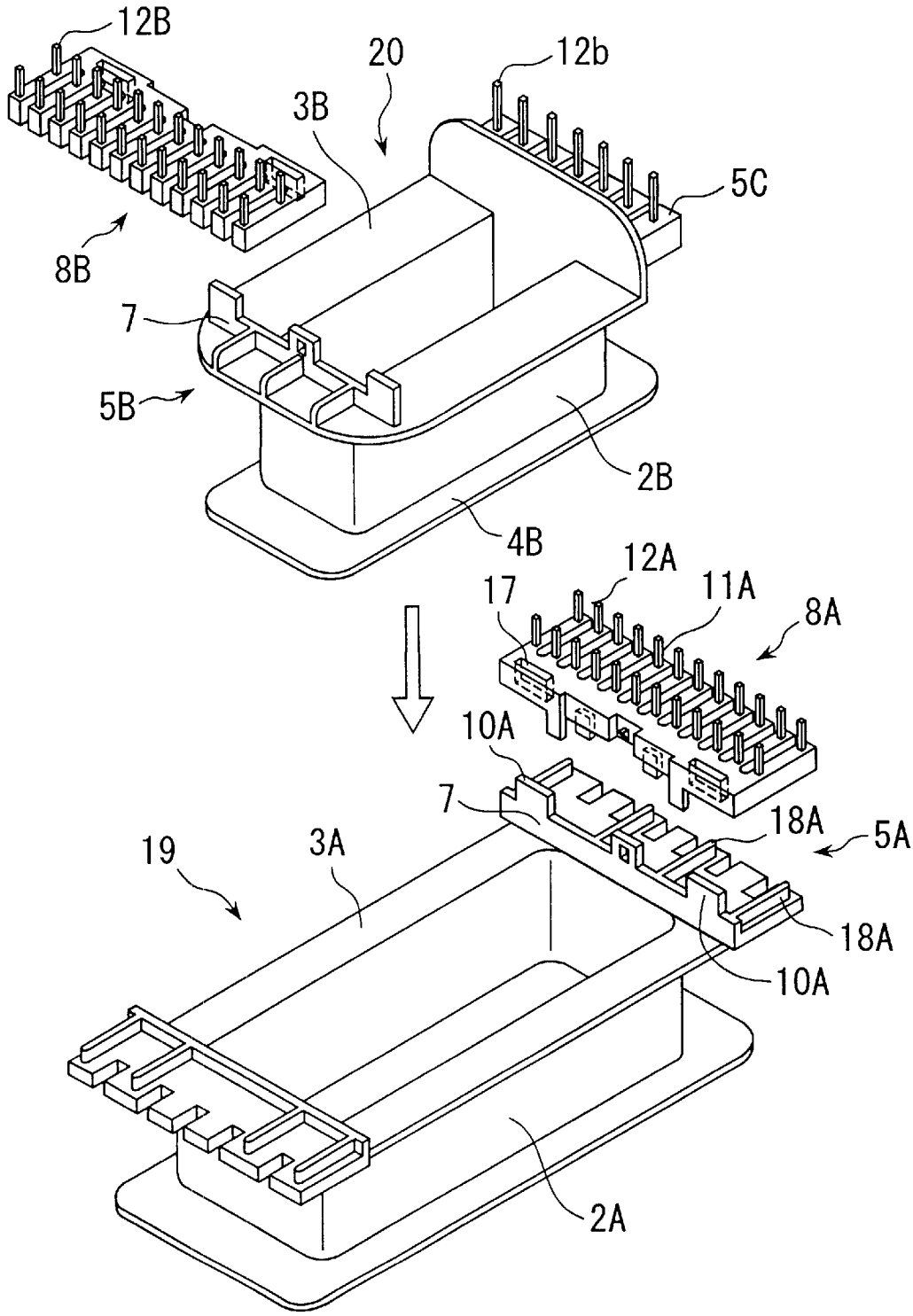
FIG. 11 is an exploded perspective view of a fifth embodiment of the present invention.
Figure 12:
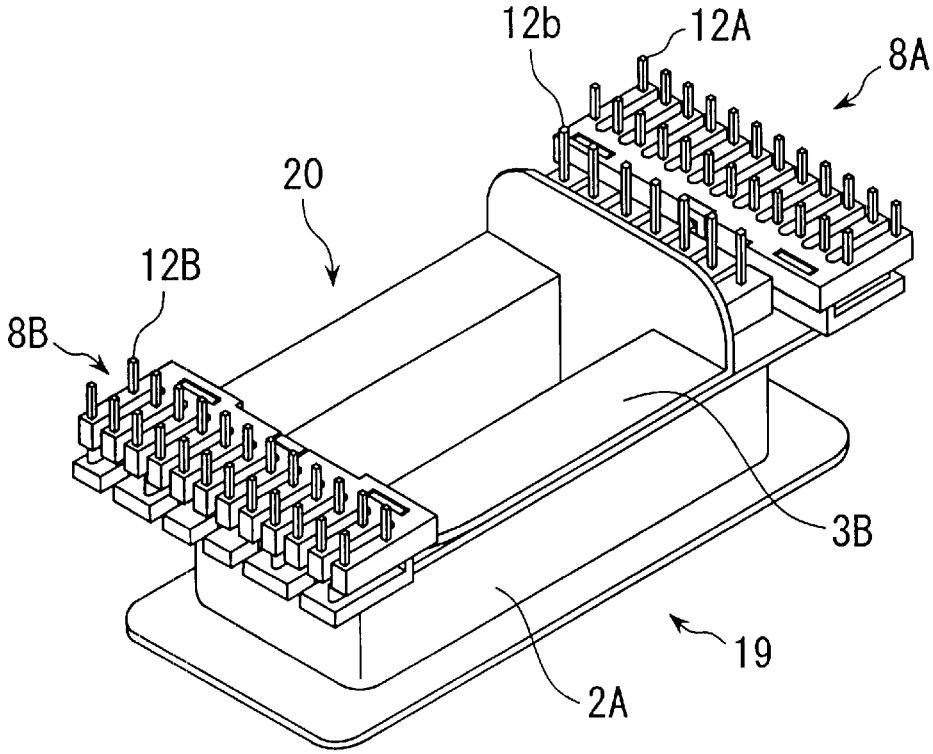
FIG. 12 is an assembled perspective view of the fifth embodiment of the present invention.

FIG. 11 is an exploded perspective view of a fifth embodiment of the present invention, and FIG. 12 shows an assembled state thereof.

In this embodiment, the present invention is applied to a coil bobbin having a double structure constituted by an outer coil bobbin 19 and inner coil bobbin 20. Basic configurations of respective parts are the same as in the first to third embodiments.

That is, an end of an upper flange 3A of the outer coil bobbin 19 is formed with a terminal board mounting portion 5A, to which a terminal board 8A is configured to be mountable.

As shown in FIG. 10A, the terminal board 8A is formed into a long shape, and numbers of terminals 12A are implanted at intervals along its length. Deep drawing grooves 11A are formed between the respective terminals 12A. Further, both sides of an inner end of the terminal board 8A are formed with through holes 17.

The terminal board mounting portion 5A formed on one end of the upper flanges 3A of the outer coil bobbin 19 is formed into a long shape corresponding to the terminal board 8A. Both sides of an upper surface of the terminal board mounting portion 5A are respectively formed with reinforcing ribs 18A. The reinforcing ribs 18A are also respectively formed on the inside. Further, an upper portion of a rib 7 is formed with side walls 10A to be inserted in the through holes 17.

In a drum 2A of the outer coil bobbin 19, a lower flange 4B and drum 2B of the inner coil bobbin 20 are accommodated (see FIG. 12).

Other end of an upper flange 3B of the inner coil bobbin 20 is formed with a terminal board mounting portion 5B which has a rib 7 formed with side walls and/or reinforcing ribs as shown in the first to the third embodiments, and a terminal board 8B is mounted on this portion.

An end of the upper flange 3B of the inner coil bobbin 20 is formed with a terminal board 5C in which pin terminals 12*b* are implanted. The terminal board 5C is placed on the terminal board 8A side mounted on the outer coil bobbin 19 (see FIG. 12).

At the time of assembling a transformer, a primary coil (not shown) is wound around a drum 2B of the inner coil bobbin 20, and its lead wires (not shown) are fastened to predetermined terminals 12B.

The inner coil bobbin 20 is incorporated in the outer coil bobbin 19.

A secondary coil (not shown) is wound around the drum 2A of the outer coil bobbin 19, and its lead wires (not shown) are fastened to predetermined terminals 12A.

A core (not shown) is incorporated in the assembly as known, and the transformer is assembled.

As described above, according to the present invention, in the coil bobbin configured such as to mount the terminal board 8, 8A, 8B to the terminal board mounting portion 5, 5A, 5B of the upper flange 3, 3A, 3B, the upper portion of the rib 7 formed on the inside of the terminal board mounting portion 5, 5A, 5B is provided with a plurality of walls for mounting the terminal board in an extending manner, and the inner end of the terminal board 8, 8A, 8B is formed with the through holes 17 in which the walls are inserted, thus not leading to the increase in the length of the terminal board mounting portion 5, 5A, 5B and terminal board 8, 8A, 8B to permit miniaturization of the coil bobbin.

The inner surface of the terminal board 8, 8A, 8B is formed with the projection 14, and the wall formed on the rib 7 of the terminal board mounting portion 5, 5A, 5B is formed with the through hole 9*a* or recess 9*b* to be engaged with the projection 14 when the terminal board 8, 8A, 8B is mounted to the terminal board mounting portion 5, 5A, 5B, thus preventing coming off of the terminal board 8, 8A, 8B.

The rib 7 is clipped between the outer clipping tabs 16 and concavity 13 to prevent rattling and permit firm mounting.

Further, forming the inner clipping tabs 15 permits firmer mounting.

Moreover, even when the oblong terminal board 8, 8A, 8B formed from molding warps, the side walls on the upper flange side are inserted in the through holes 17 of the terminal board 8, 8A, 8B to thereby permit correcting the warp.

What is claimed is:

1. A coil bobbin wherein an end of an upper flange (3, 3A, 3B) formed on an upper end of a drum (2, 2A, 2B) is formed with a terminal board mounting portion (5, 5A, 5B), and in which a separately formed terminal board (8, 8A, 8B) is mountable on the terminal board mounting portion (5, 5A, 5B), wherein an inside of said terminal board mounting portion (5, 5A, 5B) is formed with a rib (7), whose upper portion is formed with a plurality of plate-like walls, wherein an inner end of said terminal board (8, 8A, 8B) is formed with a plurality of through holes (17) in which said walls are inserted, and wherein an inner surface of said terminal board (8, 8A, 8B) is formed with a projection (14) for engagement, and at least one of said walls is formed with a through hole (9*a*) or recess (9*b*) to be engaged with the projection (14).

2. The coil bobbin according to claim 1, wherein an inner end of said terminal board (8, 8A, 8B) is formed with outer clipping tabs (16) placed on an outside of said rib (7) and a concavity (13) placed on an inside of said rib (7), and said rib (7) is clipped therebetween.

3. The coil bobbin according to claim 1, wherein the inner end of said terminal board (8, 8A, 8B) is formed with the outer clipping tabs 16 placed on the outside of said rib (7), the concavity (13) placed on the inside of said rib 7, and also formed with an inner clipping tabs (15), and said rib 7 is clipped therebetween.

4. The coil bobbin according to claim 1, wherein at least two reinforcing ribs (18, 18A) are formed on an upper surface of said terminal board mounting portion (5, 5A, 5B).

5. A coil bobbin wherein an end of an upper flange (3, 3A, 3B) formed on an upper end of a drum (2, 2A, 2B) is formed with a terminal board mounting portion (5, 5A, 5B), and in which a separately formed terminal board (8, 8A, 8B) is mountable on the terminal board mounting portion (5, 5A, 5B), wherein an inside of said terminal board mounting portion (5, 5A, 5B) is formed with a rib (7), whose upper portion is formed with a plurality of plate-like walls, wherein an inner end of said terminal board (8, 8A, 8B) is formed with a plurality of through holes (17) in which said walls are inserted, and wherein an inner end of said terminal board (8, 8A, 8B) is formed with outer clipping tabs (16) placed on an outside of said rib (7) and a concavity (13) placed on an inside of said rib (7), and said rib (7) is clipped therebetween.

6. The coil bobbin according to claim 5, wherein an inner surface of said terminal board (8, 8A, 8B) is formed with a projection (14) for engagement, and at least one of said walls is formed with a through hole (9*a*) or recess (9*b*) to be engaged with the projection (14).

7. The coil bobbin according to claim 5, wherein the inner end of said terminal board (8, 8A, 8B) is formed with the outer clipping tabs 16 placed on the outside of said rib (7), the concavity (13) placed on the inside of said rib 7, and also formed with an inner clipping tabs (15), and said rib 7 is clipped therebetween.

8. The coil bobbin according to claim 5, wherein at least two reinforcing ribs (18, 18A) are formed on an upper surface of said terminal board mounting portion (5, 5A, 5B).

9. A coil bobbin wherein an end of an upper flange (3, 3A, 3B) formed on an upper end of a drum (2, 2A, 2B) is formed with a terminal board mounting portion (5, 5A, 5B), and in which a separately formed terminal board (8, 8A, 8B) is mountable on the terminal board mounting portion (5, 5A, 5B), wherein an inside of said terminal board mounting portion (5, 5A, 5B) is formed with a rib (7), whose upper portion is formed with a plurality of plate-like walls, wherein an inner end of said terminal board (8, 8A, 8B) is formed with a plurality of through holes (17) in which said walls are inserted, and wherein the inner end of said terminal board (8, 8A, 8B) is formed with the outer clipping tabs 16 placed on the outside of said rib (7), the concavity (13) placed on the inside of said rib 7, and also formed with an inner clipping tabs (15), and said rib 7 is clipped therebetween.

10. The coil bobbin according to claim 9, wherein an inner surface of said terminal board (8, 8A, 8B) is formed with a projection (14) for engagement, and at least one of said walls is formed with a through hole (9*a*) or recess (9*b*) to be engaged with the projection (14).

11. The coil bobbin according to claim 9, wherein an inner end of said terminal board (8, 8A, 8B) is formed with outer clipping tabs (16) placed on an outside of said rib (7) and a concavity (13) placed on an inside of said rib (7), and said rib (7) is clipped therebetween.

12. The coil bobbin according to claim 9, wherein at least two reinforcing ribs (18, 18A) are formed on an upper surface of said terminal board mounting portion (5, 5A, 5B).

13. A coil bobbin wherein an end of an upper flange (3, 3A, 3B) formed on an upper end of a drum (2, 2A, 2B) is formed with a terminal board mounting portion (5, 5A, 5B), and in which a separately formed terminal board (8, 8A, 8B) is mountable on the terminal board mounting portion (5, 5A, 5B), wherein an inside of said terminal board mounting portion (5, 5A, 5B) is formed with a rib (7), whose upper portion is formed with a plurality of plate-like walls, wherein an inner end of said terminal board (8, 8A, 8B) is formed with a plurality of through holes (17) in which said walls are inserted, and wherein at least two reinforcing ribs (18, 18A) are formed on an upper surface of said terminal board mounting portion (5, 5A, 5B).

14. The coil bobbin according to claim 13, wherein an inner surface of said terminal board (8, 8A, 8B) is formed with a projection (14) for engagement, and at least one of said walls is formed with a through hole (9*a*) or recess (9*b*) to be engaged with the projection (14).

15. The coil bobbin according to claim 13, wherein an inner end of said terminal board (8, 8A, 8B) is formed with outer clipping tabs (16) placed on an outside of said rib (7) and a concavity (13) placed on an inside of said rib (7), and said rib (7) is clipped therebetween.

16. The coil bobbin according to claim 13, wherein the inner end of said terminal board (8, 8A, 8B) is formed with the outer clipping tabs 16 placed on the outside of said rib (7), the concavity (13) placed on the inside of said rib 7, and also formed with an inner clipping tabs (15), and said rib 7 is clipped therebetween.

* * * * *

UNITED STATES PATENT AND TRADEMARK OFFICE

CERTIFICATE OF CORRECTION

PATENT NO. : 6,696,908 B2 
DATED : February 24, 2004
INVENTOR(S) : Kohei Okano, Yuji Haga and Atsushi Aikawa It is certified that error appears in the above-identified patent and that said Letters Patent is hereby corrected as shown below:

Title page,
Item [75], Inventors, replace "Sakado (JP) for Kohei Okano" with -- Saitama (JP) --; replace "Ogawamachi (JP) for Yuji Haga" with -- Saitama (JP) --; replace "Tsurugashima (JP) for Atsushi Aikawa" with -- Saitama (JP) --.

Signed and Sealed this

Fifteenth Day of June, 2004

JON W. DUDAS
*Acting Director of the United States Patent and Trademark Office*